US006813975B2

(12) United States Patent
Kozak

(10) Patent No.: US 6,813,975 B2
(45) Date of Patent: Nov. 9, 2004

(54) DEVICE FOR PROTECTING A USER'S FINGERS WHEN OPERATING A FLEXIBLE EXTENSION SHAFT

(76) Inventor: Burton Kozak, 1300 N. Lake Shore Dr., No. 28C, Chicago, IL (US) 60610

( * ) Notice: Subject to any disclaimer, the term of this patent is extended or adjusted under 35 U.S.C. 154(b) by 0 days.

(21) Appl. No.: 10/384,950

(22) Filed: Mar. 10, 2003

(65) Prior Publication Data

US 2004/0177730 A1 Sep. 16, 2004

(51) Int. Cl.[7] ..... B25G 1/002
(52) U.S. Cl. ..... 81/177.6; 81/64
(58) Field of Search ..... 81/177.6, 57.43, 81/64, 177.7, 177.75, 177.8, 184; 818/177.8

(56) References Cited

U.S. PATENT DOCUMENTS 2,814,322 A * 11/1957 Kupfrian ..... 81/64
3,378,286 A * 4/1968 Gottschald ..... 403/51
4,530,261 A * 7/1985 Ventura ..... 81/177.75
4,748,872 A * 6/1988 Brown ..... 81/57.26
4,876,929 A * 10/1989 Kozak ..... 81/57.43
5,003,849 A * 4/1991 Lawrie ..... 81/184
6,311,583 B1 * 11/2001 Izumisawa ..... 81/57.13
6,334,620 B1 * 1/2002 Reetz et al. ..... 277/635

* cited by examiner

*Primary Examiner*—Hadi Shakeri
(74) *Attorney, Agent, or Firm*—Cherskov & Flaynik

(57) ABSTRACT

A device 20 for protecting a user's fingers when operating a flexible extension shaft 10 includes a first end portion 22 secured to a rigid member 9 of the shaft 10 via clamp means 26, a second end portion 24 that engages a movable member 8 of the shaft 10, a mid-portion member 30 integrally joined to the first and second end portions 22 and 24 whereby relative movement between the rigid member 9 and the movable member 8 is unobstructed by the mid-portion member 30 irrespective of the relative positions of the rigid member 9 and the movable member 8, the mid-portion member 30 being configured to prevent a user's fingers from being "pinched" between the rigid member 9 and the movable member 8 irrespective of the position of the user's hand upon the flexible extension shaft 10.

21 Claims, 11 Drawing Sheets

DEVICE FOR PROTECTING A USER'S FINGERS WHEN OPERATING A FLEXIBLE EXTENSION SHAFT

BACKGROUND OF THE INVENTION

1. Field of the Invention

The present invention relates to flexible extension shafts (see FIG. 1), a tool that permits a rotary drive device to impart rotary motion upon a distal tool bit by inserting one end of the flexible extension shaft into the collet of the rotary drive device, and by inserting the tool bit into the opposing end of the flexible extension shaft More particularly, the present invention provides a device that protects a user's fingers when operating the flexible extension shaft irrespective of the position of the user's hand upon the flexible extension shaft.

2. Background of the Prior Art

Flexible extension shafts come in a variety of sizes and configurations for the purpose of facilitating the transfer of rotary motion from a hand held rotary drive device to a tool bit that can only engage a preselected fastener if the tool bit is physically separated from the cumbersome rotary drive device. A person operates a flexible extension shaft by inserting a first end of the shaft into the collet of the drive device, inserting a preselected tool bit into the opposing end of the shaft, then holding the second end with the tool bit therein such that the tool bit engages a fastener while the person operates the drive device with his other hand to impart rotary motion upon the fastener. On occasion, the user must bend the shaft to achieve engagement between the tool bit and the fastener.

Referring to FIG. 1, the problem with bending the shaft and at the same time holding the second end of the shaft while the tool bit engages the fastener, is that the user's fingers can be pinched between movable and rigid members 8 and 9 that form the second end of the shaft 10. More specifically, an outer end portion 58 of the movable member 8 snugly receives the tool bit (not pictured). A relatively smaller inner end portion 52 of the movable member 8 slidably inserts into a receiving end portion 50 of the rigid member 9. The movable member 8 is extended relative to the rigid member 9 when the shaft 10 is straight. The inner end portion 52 of the movable member 8 and the receiving end portion 50 of the rigid member 9 cooperate to form a recess 48 when the shaft is straight When the shaft is manipulated from a straight to a bent position, the movable member 8 is forcibly pulled into the rigid member 9 thereby disposing the relatively larger, knurled outer end portion 62 of the movable member 8 adjacent to the receiving end portion 50 of the rigid member 9 which could pinch a finger if the finger was positioned in the recess during the bending of the shaft 10.

A need exists for a device that will circumscribe the recess between the movable and rigid members irrespective of the position of the movable member relative to the rigid member to protect the user's fingers irrespective of the position of the user's hand upon the flexible extension shaft. Further, the device must not obstruct the operation of the shaft when the movable member is forcibly slid toward or away from the rigid member when the shaft is correspondingly bent or straightened.

SUMMARY OF THE INVENTION

It is an object of the present invention to overcome many of the disadvantages associated with manually operating a flexible extension shaft that transfers rotary motion from a drive tool to a tool bit.

A principle object of the present invention is to provide a device that protects a user's fingers when operating a flexible extension shaft. A feature of the device is a deformable member that is circumferentially disposed about portions of movable and rigid members. An advantage of the device is that a user's fingers will not be "pinched" irrespective of hand placement upon the flexible extension shaft.

Another object of the present invention is to provide a device that does not interfere with the operation of the flexible extension shaft. A feature of the device is relatively small annular protuberance or "bulge" that is formed at a mid-portion of the deformable member, the bulge being disposed proximate to a recess formed when the movable member is extended relative to the rigid member. Another feature of the device is a relatively large annular bulge formed at the mid-portion of the deformable member when the movable member is slid toward the rigid member. An advantage of the device is that the mid-portion of the deformable member is prevented from being pinched between the movable and rigid members irrespective of the position of the movable member relative to the rigid member as the flexible extension shaft is manually manipulated to a bent position.

Still another object of the present invention is to provide a device that is relatively easy to secure to the flexible extension shaft. A feature of the device is cylindrical first and second end portions integrally joined to a mid-portion member to form the deformable member, the first and second end portions engaging cylindrical surface portions of corresponding rigid and movable members of the flexible extension shaft. An advantage of the device is that a clamp is capable of engaging the first end portion sufficiently tight to maintain the positions of the first and second end portions relative to the corresponding rigid and movable members.

Yet another object of the present invention is to provide a device that can be secured to the flexible extension shaft without using any banding or clamping means. A feature of the device is a recess in the inner wall of the first end portion. Another feature of the device is a knurled inner wall of the second end portion. An advantage of the device is that the recess in the inner wall engages a ridge on the surface of the rigid member thereby preventing the device from longitudinally moving upon the flexible extension shaft. Another advantage of the device is that the knurled inner wall of the second end portion cooperatively engages a knurled surface portion of the movable member thereby preventing the device from radially moving upon the flexible extension shaft.

Another object of the present invention is to provide an alternative device that protects a user's fingers when operating an alternative flexible extension shaft. A feature of the alternative device is a bulge that is disposed closer to a first end portion than to a second end portion. Another feature of the alternative device is that the second end portion is secured to the rigid member via meshing knurled surfaces of the inner wall of the second end portion and the outer wall of the rigid member. An advantage of the alternative device is that the bulge prevents the user's fingers from being pinched when a moving member of the flexible extension shaft is forcibly pulled into a rigid member of the shaft when the shaft is manually manipulated from a straight to a bent position. Another advantage of the alternative device is that the second end portion is capable of being secured by a band or clamp to the rigid member of the alternative flexible extension shaft without the first end portion being secured to the movable member thereby allowing a rounded portion of the movable member to be pulled into the rigid member while the first end portion and the bulge of the mid-portion member prevent the user's fingers from being pinched irrespective of the position of the user's hand upon the alternative flexible extension shaft.

Briefly, the invention provides a device for protecting a user's fingers when operating a flexible extension shaft comprising a first end portion disposed upon a rigid member of the flexible extension shaft; an opposing second end portion cooperatively disposed upon a movable member of the flexible extension shaft; means for securing said first end portion to the rigid member; means for joining said first and second end portions whereby relative movement between the rigid member and the movable member of the flexible extension shaft is unobstructed by said joining means irrespective of the relative positions of the rigid member and the movable member; and means for preventing a user's finger from being disposed between the rigid member and the movable member irrespective of the position of the user's hand upon the flexible extension shaft.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
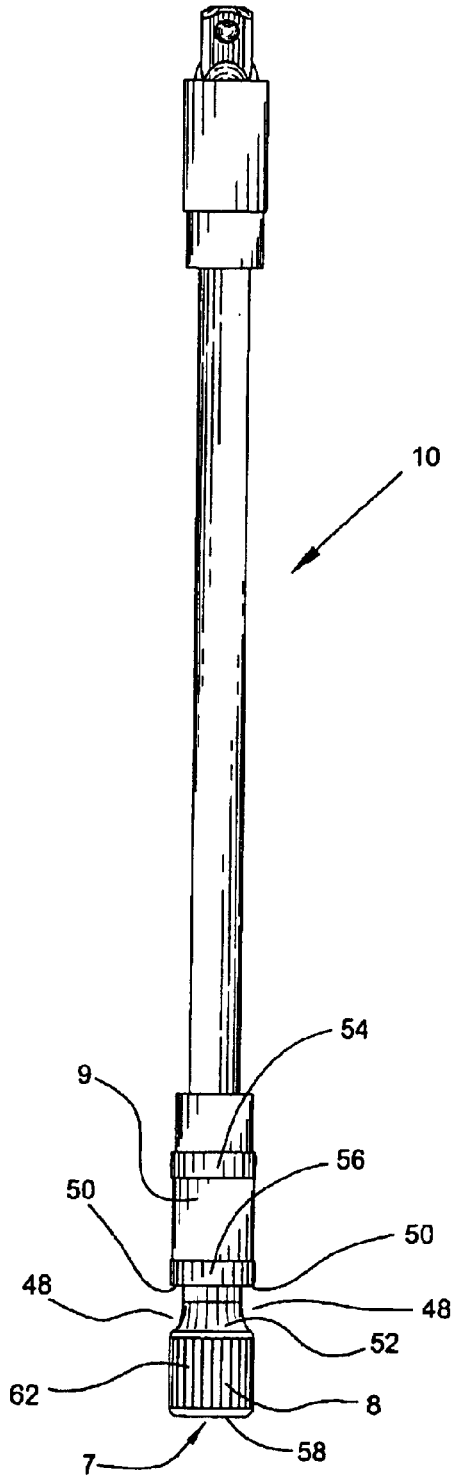
prior art Fig. 1
FIG. 1 is a front elevation view of a prior art flexible extension shaft disposed in a straight or linear position.

Referring now to the figures and in particular to FIGS. 1–4 and 7–10, a device for protecting a user's fingers when operating a movable member or fitting 8 movably or slidably joined to a rigid member 9 that is rigidly joined to a flexible sleeve 6 to form a tool receiving end 7 of a flexible extension shaft 10 (the flexible extension shaft 10 is not part of the present invention), is denoted by numeral 20. The device 20 includes a deformable member 21 that is fabricated from relatively thin rubber or similar deformable, yet resilient material that is sufficiently durable to tolerate rugged use. The device 20 further includes clamp means 26 that secures a first end portion 22 of the deformable member 21 to the rigid member 9. A second end portion 24 of the deformable member 21 is allowed to "ride upon" or otherwise remain unattached to the movable portion 8. Alternatively, the second end portion 24 may be attached to the movable portion 8, but would result in either the restricted rotary motion of the movable member 8 or the tearing of the deformable member 21. The clamp means 26 includes wrapping bands, clamps or similar securing devices (all well known to those of ordinary skill in the art) that are radially disposed about the peripheries of the first end portion 22 (and second end portion 24 if required see FIG. 10) such that when tightened, the clamping means 26 anchors the first end portion 22 to the rigid member 9.

The deformable member 21 includes a mid-portion member 30 integrally joined to the first and second end portion 22 and 24, and configured to "bulge" whereby relative movement between the rigid member 9 and the movable member 8 is unobstructed by the mid-portion member 30 irrespective of the position of the movable member 8 relative to the rigid member 9. The mid-portion member 30 is configured to prevent a user's finger from being disposed between the movable and rigid members 8 and 9 irrespective of the position of the user's hand upon the flexible extension shaft 10. The deformable member 21 is a substantially cylindrically configured, solid piece of rubber that snugly engages cooperating portions of the movable and rigid members 8 and 9.

Figure 3:
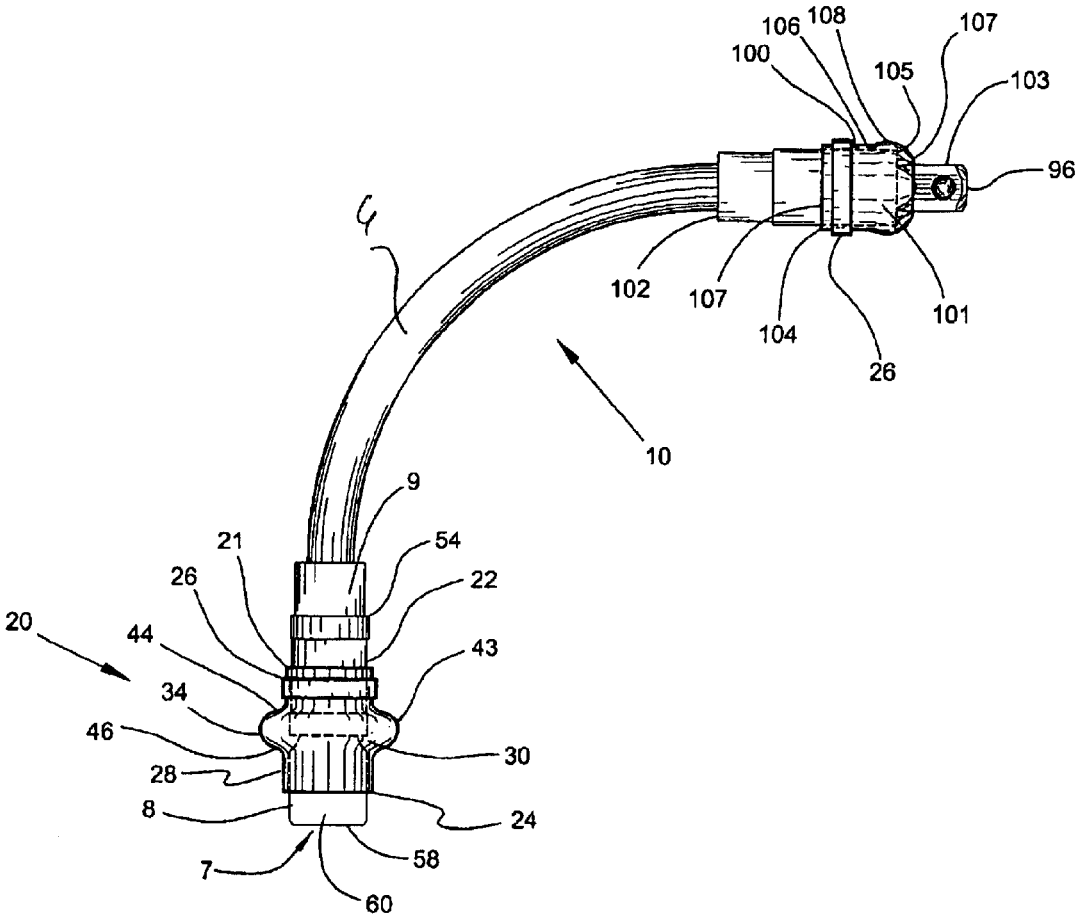
FIG. 3 is a front elevation view of the device and flexible extension shaft of FIG. 2 but with the shaft disposed in a "bent" position.

The mid-portion 30 of the deformable member 21 includes a relatively small annular protuberance or "bulge" 32 (see FIG. 8) when the movable member 8 is extended relative to the rigid member 9 thereby disposing the deformable member 21 in a "normal" position. The deformable member 21 forms a relatively large annular bulge 34 (see FIG. 9) when the movable member 8 is forcibly drawn into the rigid member 9 thereby disposing the deformable member 21 in a "compressed" position which occurs when the flexible extension shaft 10 is disposed in a "bent" position as depicted in FIG. 3.

Figure 8:
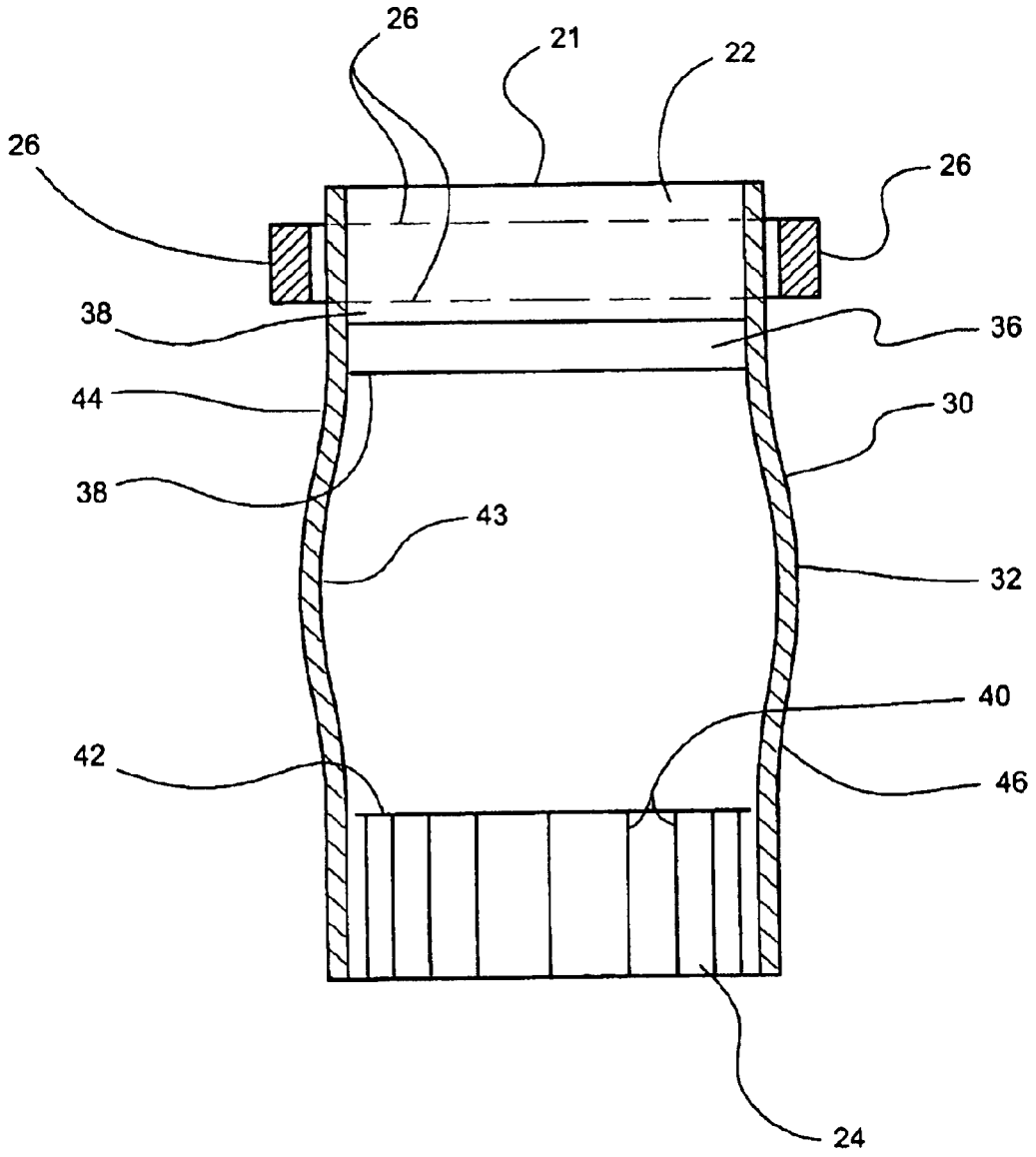
FIG. 8 is a section view of the device taken along line 8—8 of FIG. 7 with the flexible extension shaft disposed in a linear position.

The bulge 32 of the straight or relaxed deformable member 21 depicted in FIG. 8, has a radial mid-portion 43 that includes relatively larger outer and inner diameters than corresponding outer and inner diameters of first and second wall portions 44 and 46 of the mid-portion member 30. The first and second wall portions 44 and 46 are integrally joined to corresponding first and second end portions 22 and 24. The mid-portion member 30 is continuous, uniform and circumferentially disposed about portions of the movable and rigid members 8 and 9, and a recess 48 (see FIGS. 1, 7 and 10) configured by an outer end 50 of the rigid member 9 and an inner portion 52 of the movable member 8, whereby the recess 48 is encased by the mid-portion member 30 irrespective of the position of the movable member 8 relative to the rigid member 9. The presence of the bulge 32 irrespective of the position of the movable member 8, prevents the deformable member 21 from interfering with the operation of the flexible extension shaft 10. More specifically, the bulge 32 maintains separation between the mid-portion member 30, and the end 50 of the rigid member 9 and the inner portion 52 of the movable member 8 irrespective of the flexible extension shaft 10 being operated in a straight or bent position (see FIGS. 1, 2 and 3).

The mid-portion member 30 is dimensioned to dispose the first end portion 22 between first and second ridges 54 and 56 on the rigid member 9 thereby facilitating the securing of the first end portion 22 to the rigid member 9. The mid-portion member 30 is further dimensioned to dispose the second end portion 24 proximate to an outer end 58 of the movable member 8 thereby providing an exposed outer portion 60 of the movable member 8, the exposed outer portion 60 providing a knurled surface for the user to grip while operating the flexible extension shaft 10.

Figure 9:
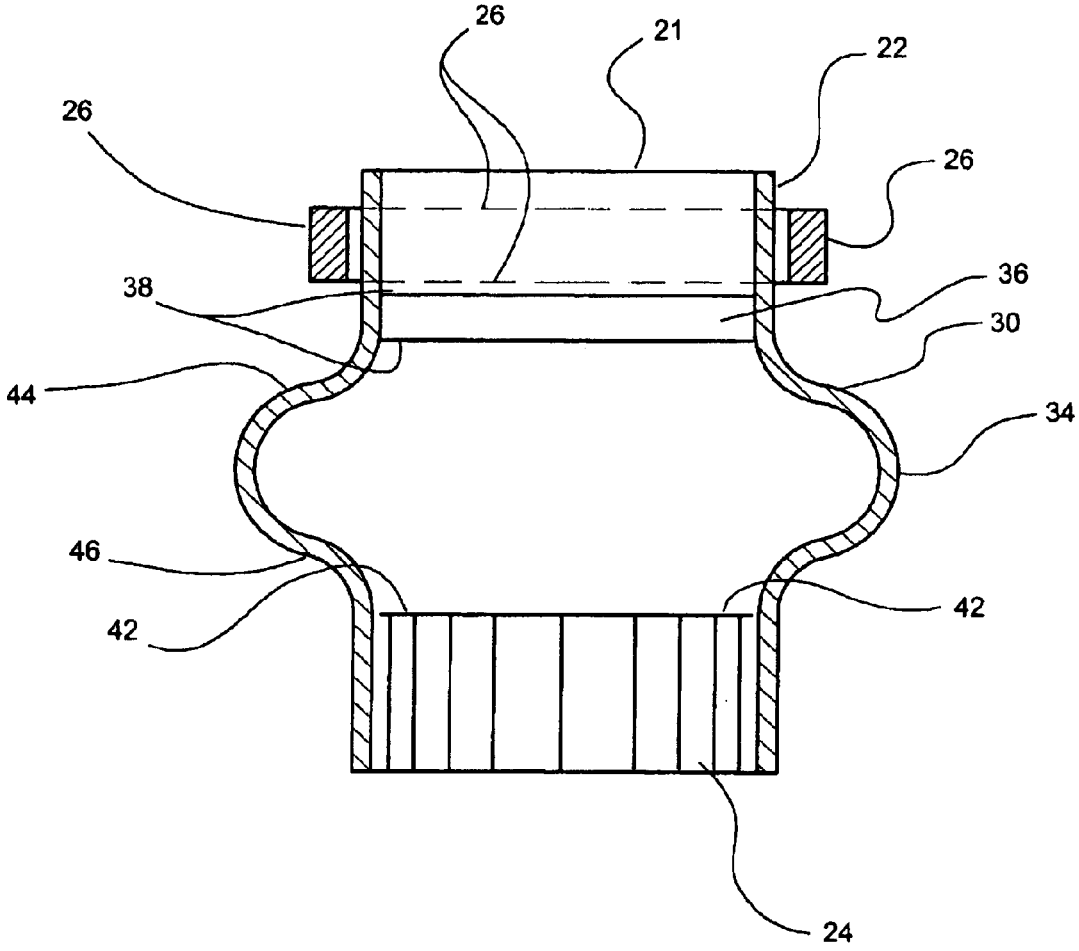
FIG. 9 is a view of the device depicted in FIG. 8 in a compressed position when the flexible extension shaft is disposed in a bent position.
Figure 10:
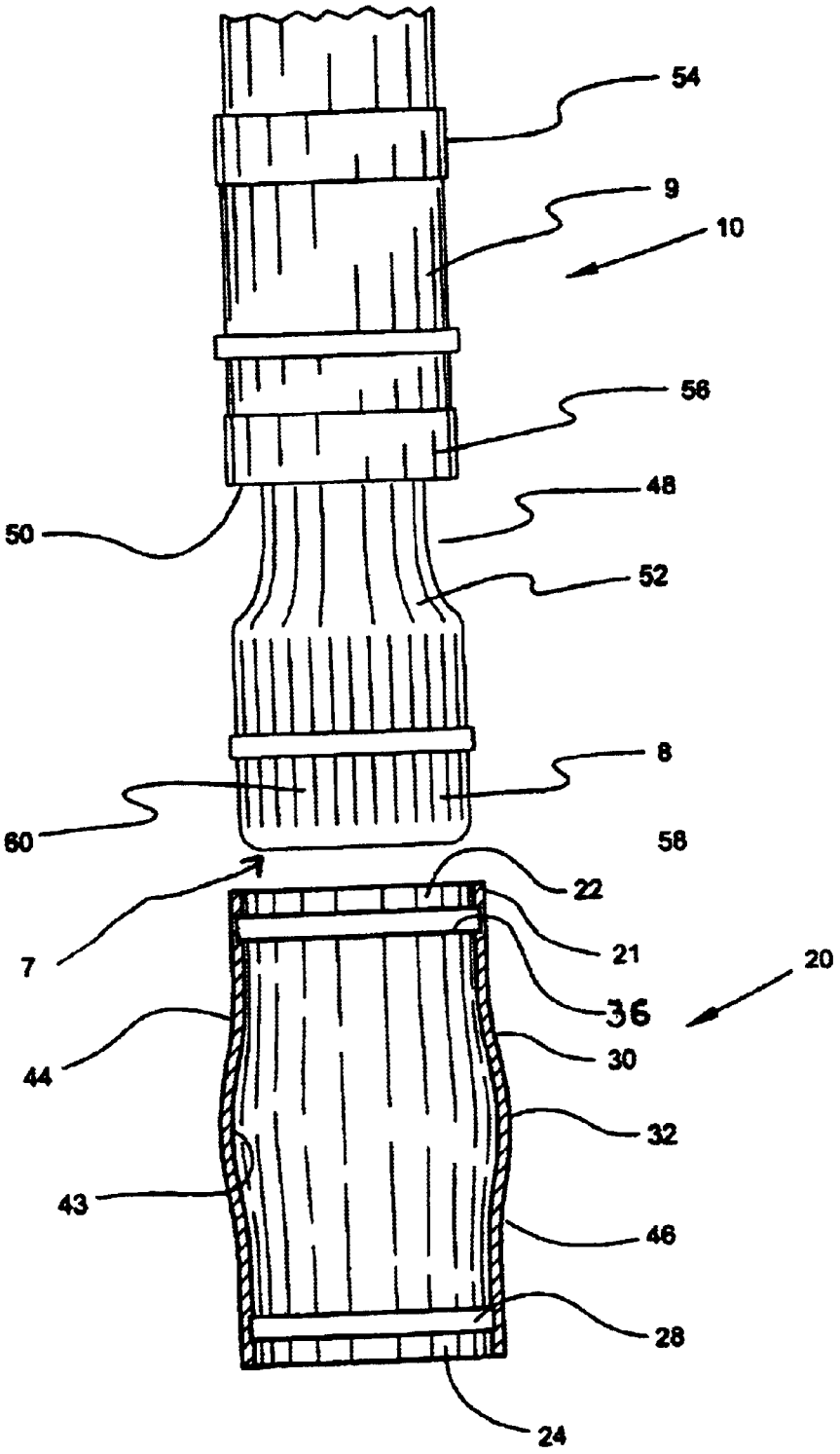
FIG. 10 is a front elevation view of the device of FIG. 2 detached from the tool receiving end of the flexible extension shaft.

Referring to FIGS. 8 and 9, an alternative method for securing the device 20 to the members 8 and 9, is to delete the clamp means 26 and include an inner recess 36 in a cylindrical inner wall 38 of the first end portion 22, and a knurled portion 40 in an inner cylindrical wall 42 of the second end portion 24. The inner recess 36 snugly receives the second ridge 56 of the rigid member 9. The knurled portion 40 snugly receives a corresponding knurled portion 62 of the movable member 8. The inner recess 36 and the knurled portion 62 of the deformable member 21 cooperate with the second ridge 56 and the knurled portion 40 to maintain the position of the first and second end portions 22 and 24 of the deformable member 21 upon the corresponding rigid and movable members 9 and 8 irrespective of the position of the movable member 8 relative to the rigid member 9.

Figure 4:
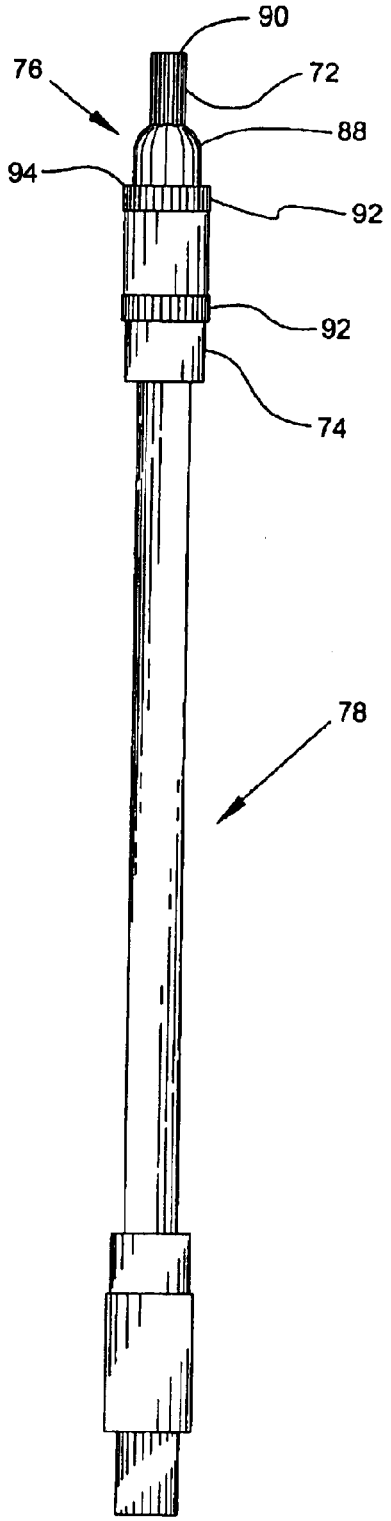
prior art Fig. 4
FIG. 4 is a front elevation view of an alternative prior art flexible extension shaft in a linear position.
Figure 5:
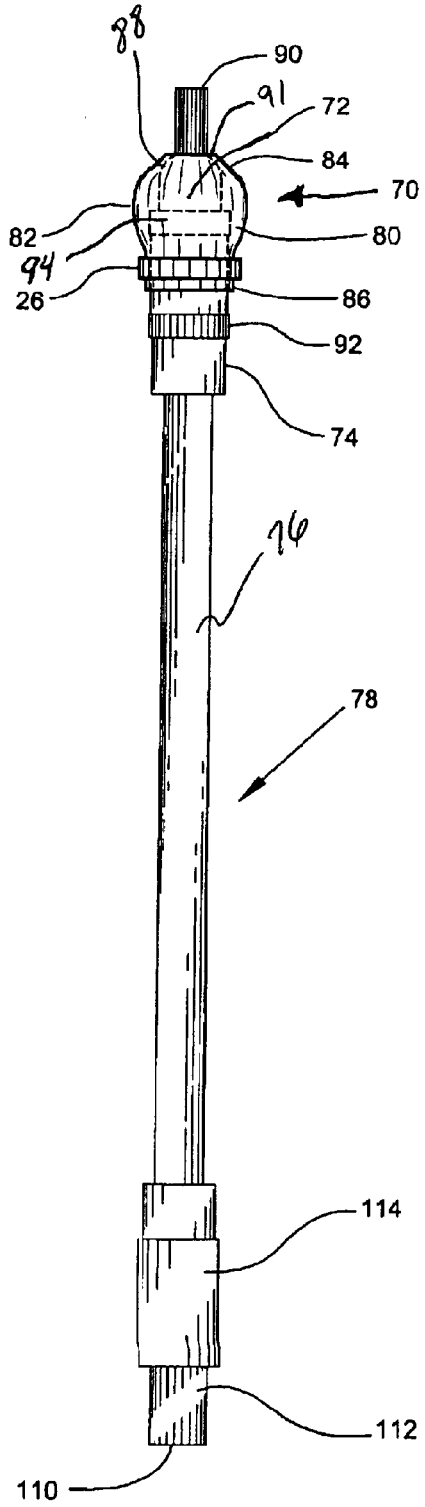
FIG. 5 is a front elevation view of an alternative device for protecting a user's fingers when operating the alternative flexible extension shaft in accordance with the present invention, the alternative device being secured to the insertion end of the alternative flexible extension shaft of FIG. 4.
Figure 6:
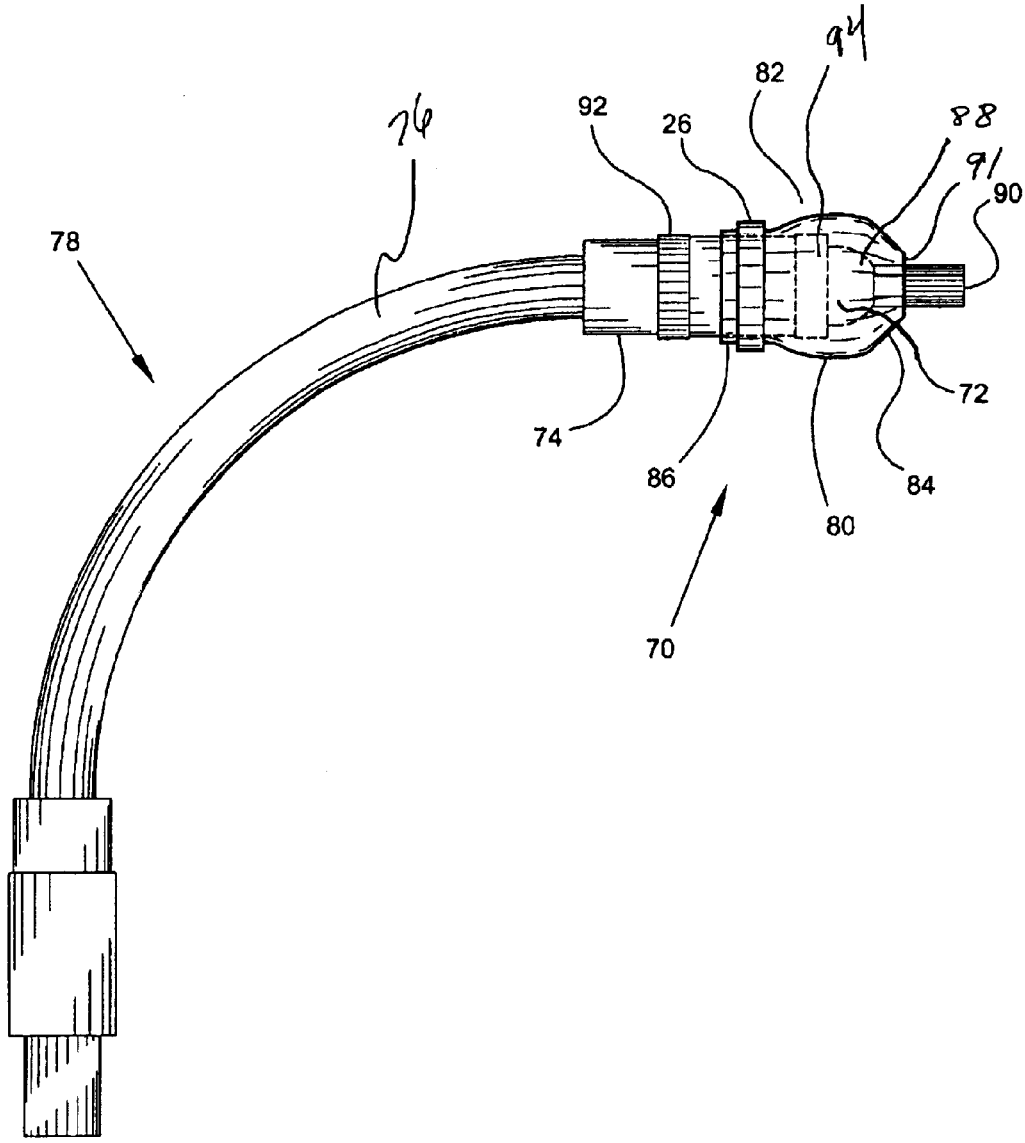
FIG. 6 is a front elevation view of the alternative device and alternative flexible extension shaft of FIG. 5 but with the alternative shaft disposed in a bent position.
Figure 7:
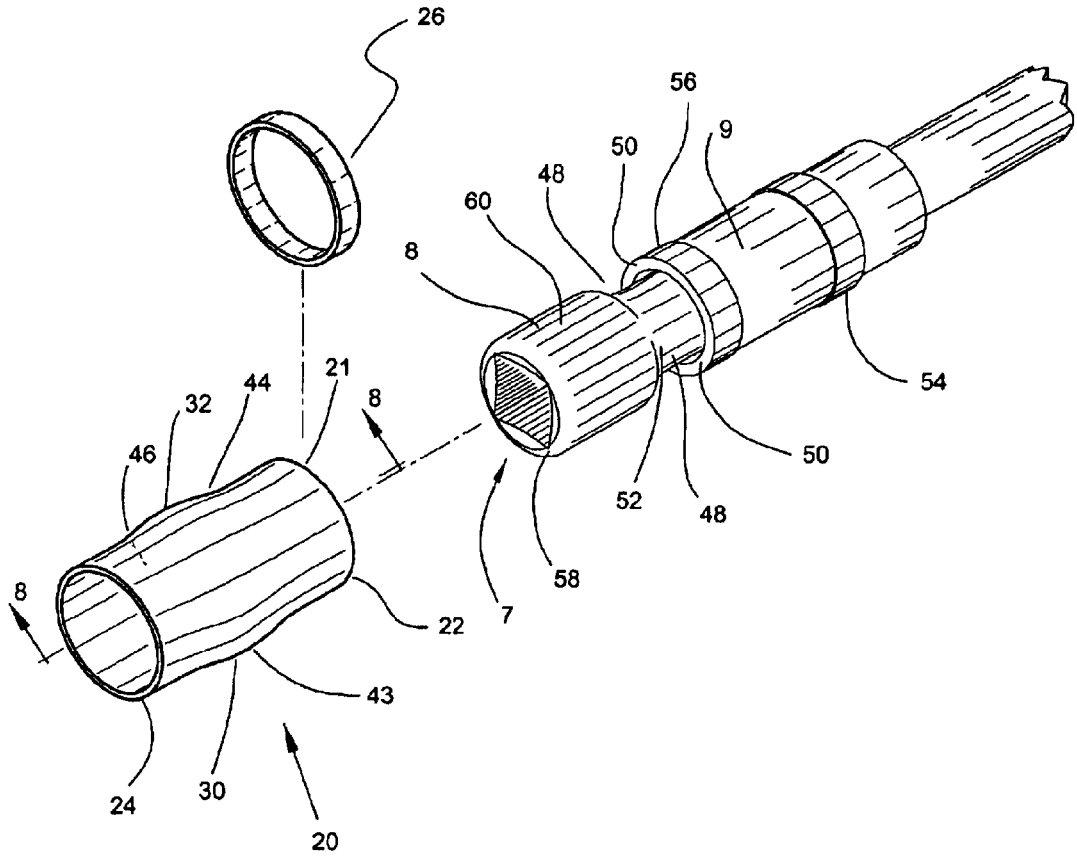
FIG. 7 is an exploded perspective view of the device of FIG. 2 detached from the tool receiving end of the flexible extension shaft.

Referring now to FIGS. 4, 5 and 6, an alternative device for protecting a user's fingers when operating a movable member or fitting 72 that is movably joined to a rigid member 74 that is rigidly joined to a flexible sleeve 76 of an alternative flexible extension shaft 78, is denoted by numeral 70. The alternative device 70 is substantially the same as the device 20 detailed above except that the alternative device 70 is configured and dimensioned to provide a mid-portion member 80 having a relatively larger bulge 82 that includes most of a first end portion 84. The bulge 82 is disposed about and separated from an outer end 94 of the rigid member irrespective of the movable member 72 being extended or drawn into the rigid member 74. The first end 84 of the alternative device 70 congruently engages a smooth rounded portion 88 of the movable member 72 when the flexible extension shaft 78 is disposed linearly as depicted in FIG. 5. The rounded portion 88 is integrally joined to a hexagonal end portion 90 that ultimately inserts into a rotary drive tool. The end portion 90 protrudes through an orifice 91 in the first end 84 of the device 70, the orifice 91 being relatively larger in diameter than the largest cross-sectional diagonal dimension of the end portion 90. When the shaft 78 is disposed in a bent position as depicted in FIG. 6, the rounded portion 88 is drawn into the rigid member 74 thereby positioning the first end 84 of the alternative device 70 radially about and distally from the surface of the hexagonal end portion 90.

The second end 86 of the device 70 is relatively larger than the first end 84, and dimensioned to snugly engage a sufficient outer surface area (including knurled portions 92) of the rigid member 74. Clamp means 26 secure the position of the second end 86 upon the rigid member 74 irrespective of the shaft 78 being disposed in a linear or bent position. The first end 84 of the alternative device 70 is not secured to the movable member 72 thereby allowing the rounded portion 88 to be drawn into the device 70 when the shaft 78 is in a bent position. The configuration of the device 70, including the bulge 82, remains constant irrespective of the alternative flexible shaft 78 being disposed in a straight or bent position. Thus, the bulge 82 of the alternative device 70 maintains its configuration (unlike the device 20 detailed above) and prevents a user's fingers from engaging the movable member 72 while the rounded portion 88 of the movable member 72 enters and exists the rigid member 74 when the shaft 78 is manipulated from a straight to a bent position.

In operation, the device 20 is forcibly positioned upon a straight, flexible extension shaft 10 such that a mid-portion 43 of a bulge 32 is disposed about recess 48 formed when a movable member 8 is extended relative of a rigid member 9 which is joined to the sleeve 6 of the shaft 10. The bulge 32 is formed in the manufacturing process (a method will know to those of ordinary skill in the art), or is formed by manually positioning first and second end portions 22 and 24 of a deformable member 21 upon corresponding rigid and movable members 9 and 8 such that an outward protuberance perpendicular to the midpoint of the longitudinal axis of the deformable member 21 results. The deformable member 21 is then secured to the rigid member 9 by utilizing clamp means 26 at a corresponding first end portion 22 of the deformable member 21.

Figure 2:
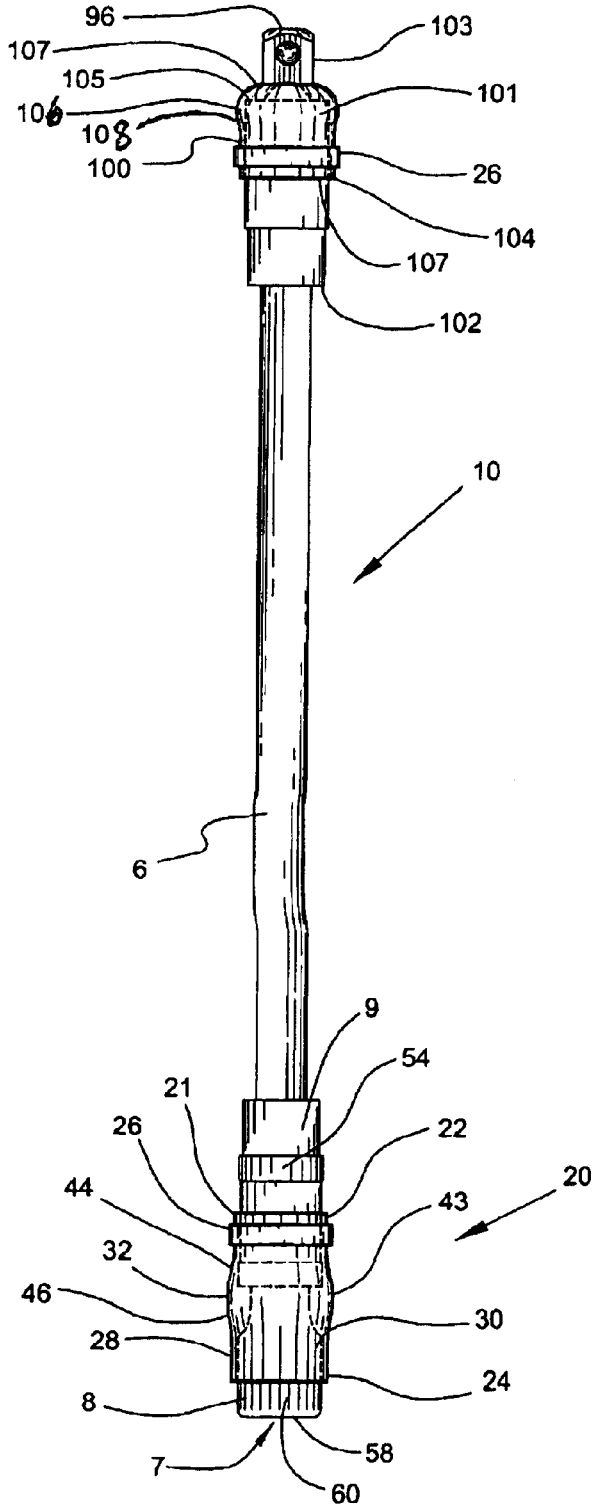
FIG. 2 is front elevation view of a device for protecting a user's fingers when operating a flexible extension shaft in accordance with the present invention, the device being secured to the flexible extension shaft of FIG. 1.

After the deformable member 21 has been secured to the flexible extension shaft 10, an insertion end 96 of the shaft 10 is positioned in a collet or chuck portion of a rotary drive tool (not part of the invention) to impart rotary motion to the shaft 10. After the insertion end 96 of the shaft 10 has been forcibly secured to the rotary drive device by the chuck, the shaft 10 is disposed in a substantially "straight" position such that the longitudinal axis of the shaft 10 is linear and the deformable member 21 forms a relatively small bulge 32 at the mid-portion member 30 as depicted in FIG. 2. The bulge 32 increases in diameter to the relatively large bulge depicted in FIG. 3 when the shaft 10 is forcibly transformed from a straight to a bent configuration during use.

The bulging mid-portion member 30 prevents the user's fingers from being pinched between the movable and rigid members 8 and 9 when the movable member 8 is forcibly pulled into the rigid member 9 by the normal operation of the shaft 10 when the shaft 10 is manually manipulated from a straight to a bent configuration. Further, the permanent bulge configuration of the deformable member 21 prevents the mid-portion member 30 from being disposed in the recess 48 formed by the movable and rigid members 8 and 9. Maintaining sufficient distance between the mid-portion member 30 and the portions of the members forming the recess 48, prevents the mid-portion member 30 from being pinched between the movable and rigid members 8 and 9, which would obstruct the bending of the shaft 10 when forcibly urged from a straight to a bent position.

Referring now to FIGS. 1, 2 and 3, the flexible extension shaft 10 is depicted with a modified device 100 secured to a rigid member 101 which is secured to a flexible sleeve 6 via an inner end 102. The rigid member 101 is joined to a movable member 103 that includes the insertion end 96. The insertion end 96 protrudes through the device 100 via an orifice 107. The orifice 107 is relatively larger in diameter than the diagonal dimension of a cross-section of the insertion end 96. The modified device 100 protects a user's fingers when inserting or removing the insertion end 96 of the shaft 10 into or from the chuck of the rotary drive tool. Although the rigid member 101 of the shaft is grasped by the user's hand only when inserting or extracted the insertion end 96, the user's fingers can still be pinched between an outer end 105 of the rigid member 101 and the movable member 103. To protect the user's fingers, end portion 104 of the device 100 is secured to cooperating portion 107 of the rigid member 101 via clamp means 26.

The modified device 100 is substantially the same as the above described device 20 except for a smaller bulge 106 (compared to the bulge 32 of the above device 20 when the shaft 10 is straight) at the mid-portion 108 of the device 100 that prevents the device 100 from engaging the proximate circumferential portion of the shaft 10 configured by the outer end 105 of the rigid member 101 and the insertion end 96. The reason for the smaller bulge 106 is that the distance of travel of the movable member 103 relative to the rigid member 101 of the modified device 100, is smaller than the distance of travel of the movable member 8 relative to the rigid member 9 of the above device 20. Further, the configuration of the bulge 106 of the modified device 100 (when the shaft 10 is bent) increases a relatively smaller amount than the corresponding bulge 34 of the above device 20.

Referring again to FIG. 5, a tool receiving end 110 of the alternative flexible shaft 78 can utilize any of the three above devices 20, 70 and 100 to prevent a user's fingers from being pinched between a movable member 112 and a rigid member 114 by securing the selected device to the members as detailed above. However, when a relatively large movement occurs between the movable and rigid members 112 and 114, the device 20 should be utilized; a relatively small amount of movement between the members 112 and 114 would call for the use of either the alternative device 70 or the modified device 100.

Figure 11:
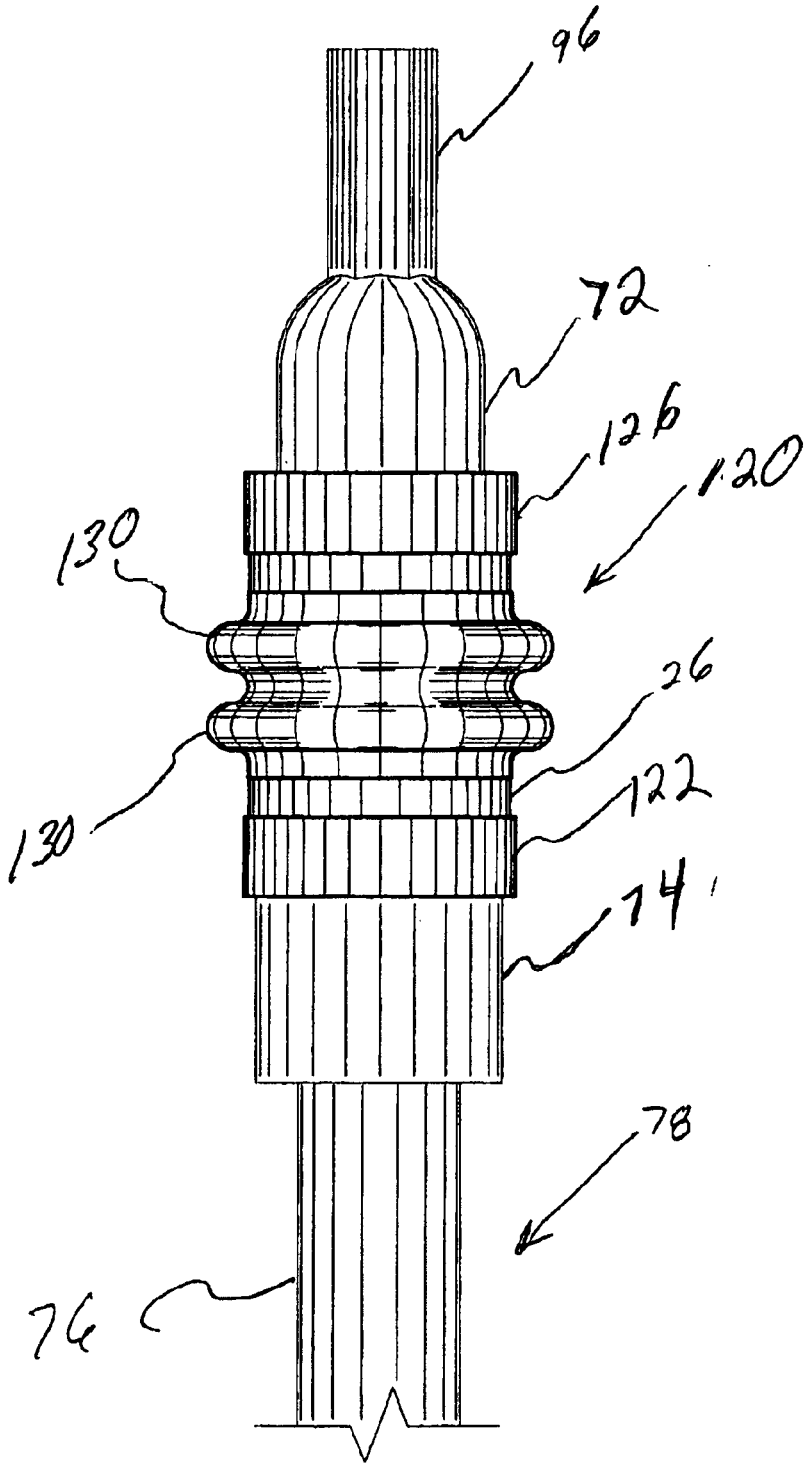
FIG. 11 is yet another alternative device for protecting a user's fingers when operating the prior art device of FIG. 4.

Referring now to FIG. 11, another modified device in accordance with the present invention is depicted and denoted as numeral 120. The modified device 120 is depicted as a replacement for the device 70 of FIGS. 5 and 6, which include the prior art device of FIG. 4. The modified device 120 includes a first end portion 122 secured to a rigid member 74 via clamping means 26. The rigid member 124 is attached to the flexible sleeve 76 of the flexible extension shaft 78. A second end portion 126 of the device 120 remains unsecured to a movable member 72. The device 120 includes a pair of bulges or protuberances 130 disposed at a mid-portion of the device 120. Although only two bulges 130 are depicted, more bulges 130 may be included thereby forming a bellows configuration. The bugles 130 prevent a user's fingers from being pinched while allowing the shaft 78 to be manipulated from a straight to a bent position. More specifically, the bulges 130 will not obstruct movement of the movable member 128 into or from the rigid member 124. The modified device 120 of FIG. 11 differs from the device 70 of FIGS. 5 and 6 in that the modified device 120 engages the movable member 72 while the device 70 is substantially separated from the movable member 72. The modified device 120 allows restrictive rotation of the movable member 72 while preventing dirt and other foreign substances from entering via the first end portion 122. The device 70 allows unrestricted rotation of the movable member 72, but permits foreign substances access via the first end portion 84.

While the invention has been described with reference to the details of the embodiment, these details are not intended to limit the scope of the invention as defined in the appended claims.

What is claimed is:

1. A device for protecting a user's fingers when operating a flexible extension shaft comprising:

a deformable member having a first end portion disposed upon a rigid member of the flexible extension shaft, an opposing second end portion cooperatively disposed upon a movable member of the flexible extension shaft, and a mid-portion configured to bulge to maintain separation between the mid-portion and the rigid and movable members of the flexible extension shaft irrespective of the flexible extension shaft being operated in a straight or bent position, said mid-portion includes a relatively larger outer diameter than outer diameters of said first and second end portions of said deformable member; and means for securing said first end portion to the rigid member such that axial and rotary movements of the rigid member relative to the movable member of the flexible extension shaft are unobstructed by said deformable member irrespective of the relative positions of the rigid member and the movable member whereby a user's fingers are prevented from being disposed between the rigid member and the movable member irrespective of the position of the user's hand upon the flexible extension shaft.

2. The device of claim 1 wherein said securing means includes a wrapping band tightly disposed about a periphery of said first end portion of said device.

3. The device of claim 1 wherein said securing means is defined by the deformable member having an inner recess that snugly receives a protuberance on an outer cylindrical wall of the rigid member.

4. The device of claim 1 wherein said securing means is defined by the deformable member having a knurled inner wall that snugly receives a knurled outer wall of the movable member.

5. The device of claim 1 wherein said mid-portion of said member includes a relatively larger inner diameter than inner diameters of said first and second end portions of said deformable member.

6. The device of claim 5 wherein said mid-portion forms a relatively small bulge when the movable member is extended relative to the rigid member.

7. The device of claim 5 wherein said mid-portion forms a relatively large bulge when the movable member is drawn into the rigid member.

8. The device of claim 1 wherein said deformable member is durable.

9. The device of claim 1 wherein said deformable member is resilient.

10. The device of claim 1 wherein said deformable member is fabricated from rubber.

11. The device of claim 1 wherein said deformable member is circumferentially disposed about a recess configured by an outer end of the rigid member and an inner portion of the movable member whereby the recess is encased by said deformable member irrespective of the position of the movable member relative to the rigid member.

12. The device of claim 11 wherein said deformable member is disposed to provide an exposed outer portion of the movable member, the exposed outer portion providing a surface for the user to grip while operating the flexible extension shaft.

13. A device for preventing pinching of a person's fingers when operating a flexible extension shaft comprising:

a deformable member secured to rigid and movable members which are joined to the flexible extension shaft, said deformable member includes first and second ends and a mid-portion having a relatively larger outer diameter than outer diameters of said first and second ends, said deformable member encasing the rigid and movable members such that axial and rotary movements of the movable member relative to the rigid member are unobstructed whereby a user's fingers cannot be pinched between the rigid and movable members irrespective of the position of the flexible extension shaft being straight or bent.

14. The device of claim 13 wherein said deformable member includes at least one end secured to a cooperating portion of the flexible extension shaft.

15. The device of claim 13 wherein said deformable member includes a mid-portion having a relatively larger inner diameter than inner diameters of either end of the deformable member.

16. The device of claim 13 wherein said mid-portion forms a relatively small bulge when the movable member is extended relative to the rigid member.

17. The device of claim 16 wherein said small bulge is disposed nearer a first end of said deformable member than a second end of said deformable member when the movable member is extended relative to the rigid member.

18. The device of claim 13 wherein said mid-portion forms a relatively large bulge when the movable member is drawn into the rigid member.

19. The device of claim 18 wherein said large bulge is disposed nearer a first end of said deformable member than a second end of said deformable member when the movable member is drawn into the rigid member.

20. The device of claim 13 wherein said first end of said deformable member is disposed radially about and distally from the surface of a hexagonal end portion of the movable member of the flexible extension shaft.

21. A method for protecting a person's fingers when operating a flexible extension shaft, said method comprising:

providing a deformable member, said deformable member having first and second ends and a mid-portion with a relatively larder outer diameter than outer diameters of said first and second ends;

securing said deformable member to a rigid member joined to the flexible extension shaft;

engaging said deformable member with a movable member secured to the flexible extension shaft;

encasing portions of the rigid and movable members with said deformable member such that axial and rotary motions of the movable member relative to the rigid member are unobstructed whereby a user's fingers cannot engage predetermined portions of the rigid and movable members irrespective of the position of the flexible extension shaft being straight or bent.

* * * * *